United States Patent [19]

Uemura et al.

[11] Patent Number: 4,574,077

[45] Date of Patent: Mar. 4, 1986

[54] PROCESS FOR PRODUCING PITCH BASED GRAPHITE FIBERS

[75] Inventors: Seiichi Uemura, Tokyo; Takao Hirose, Kamakura; Yoshio Sohda, Kawasaki; Takayoshi Sakamoto, Hiratsuka; Yoshio Kishimoto, Yokosuka, all of Japan

[73] Assignee: Nippon Oil Company Limited, Japan

[21] Appl. No.: 659,261

[22] Filed: Oct. 10, 1984

[30] Foreign Application Priority Data

Oct. 14, 1983 [JP] Japan ..... 58-190953
May 1, 1984 [JP] Japan ..... 59-37286
May 31, 1984 [JP] Japan ..... 59-10958

[51] Int. Cl.[4] ..... D01F 9/14

[52] U.S. Cl. ..... 423/447.6; 264/29.2; 423/447.2; 423/447.4

[58] Field of Search ..... 208/44; 264/29.2, 29.6, 264/29.7; 423/447.1, 447.6, 447.7, 447.8

[56] References Cited

U.S. PATENT DOCUMENTS 3,399,252 8/1968 Hough et al. ..... 264/29.2
3,595,946 7/1971 Joo et al. ..... 423/447.8
3,972,968 8/1976 Kohn ..... 423/447.8
3,974,264 8/1976 McHenry ..... 423/447.4
4,301,136 11/1981 Yamamoto et al. ..... 423/447.4 X
4,351,816 9/1982 Schulz ..... 423/447.4
4,389,387 6/1983 Miyamori et al. ..... 423/447.7
4,431,623 2/1984 Fug ..... 423/447.4 X

*Primary Examiner*—Edward J. Meros
*Attorney, Agent, or Firm*—Scully, Scott, Murphy & Presser

[57] ABSTRACT

Provided is a process for producing a pitch-based graphite fiber, which process comprises treating a pitch fiber in an oxidative gas atmosphere to render it infusible, said pitch fiber being obtained by melt-spinning a carbonaceous pitch, then heat-treating the infusibilized fiber at 400°-750° C. in an inert gas atmosphere to obtain a precarbonized fiber substantially containing oxygen, then raising the temperature to 2,000°-3,000° C. at a rate of 500° C. or higher per minute in an inert gas atmosphere and heat-treating the precarbonized fiber at the raised temperature of 2,000°-3,000° C. in said inert gas atmosphere.

5 Claims, No Drawings

PROCESS FOR PRODUCING PITCH BASED GRAPHITE FIBERS

BACKGROUND OF THE INVENTION

The present invention relates to a process for producing pitch-based graphite fibers.

Usually, pitch-based graphite fibers are produced by treating pitch fibers in an oxidative gas atmosphere to render them infusible, then heating the infusible fibers up to 800–1,300° C. at a temperature rising rate of 1–30° C. per minute in an inert gas atmosphere, heat-treating the fibers at this temperature for a long time to obtain carbonized fibers substantially free of oxygen, and then heat-treating the carbonized fibers at 2,000°–3,000° C. in an inert gas atmosphere.

The pitch-based graphite fibers thus produced by such conventional process are 40 to 50 TON/mm$^2$ in terms of elastic modulus, thus exceeding that of polyacrylonitrile-based graphite fibers, while their tensile strengths are in the range of 190 to 220 kg/mm$^2$ and thus lower than that of polyacrylonitrile-based graphite fibers. In an effort to improve physical properties of such pitch-based graphite fibers, attempts have been made, including improvement of pitch precursor, but they are not considered fully effective. Under the circumstances, it has been desired to establish a method of improving physical properties of pitch-based graphite fibers.

Shortening the graphite fiber producing time is also an important subject from the industrial standpoint. Heretofore, various catalysts and promoters have been studied for shortening the time required for infusibilization treatment, and there have been proposed metal salts, ammonium salts, inorganic acids and halogen. However, in point of the infusibilization promoting effect or physical properties of carbon fibers as the final product, satisfactory results have not been obtained yet. For example, if pitch fibers are subjected to an infusibilization treatment after contact treatment with an inorganic acid such as hydrochloric, sulfuric or nitric acid, physical properties of the final carbon fiber product will be deteriorated.

For increasing the amount of fibers treated, there have been proposed a method (Japanese Patent Publication No. 12740/1976) in which pitch fibers after spinning are deposited on a receiving vessel and then subjected to infusiblizing and calcining treatments, thereafter fibers in form of continuous filaments are drawn out from their deposited state; a method (Japanese Patent Publication No. 37967/1976 and Laid Open No. 90621/1980) in which pitch fibers are deposited on a belt conveyor, then rendered infusible and calcined; a method (Japanese Patent Laid Open No. 6547/1980) in which pitch fibers are suspended from above a bar and rendered infusible; and a method (U.S. Pat. No. 4351,816) in which infusiblized fibers are wound onto a bobbin and carbonized. However, all these methods have merits and demerits. Particularly, because of handling fragile pitch fibers or infusiblized fibers, the fibers are subject to damage, which causes napping or unsatisfactory performance of the fibers after calcination.

According to the prior art, moreover, the carbonization of infusiblized fibers is usually performed by raising the temperature to about 800°–1,300° C. at a rate of 1°–30° C. per minute in an inert gas atmosphere. In this case, it is said that if the temperature rising rate is made higher, it will cause a lowering in strength of the fibers. But, since this conventional carbonizing method requires a high temperature over a long time, it not only causes a lowering of productivity but also it is extremely disadvantageous from the economic point of view.

In the pitch-based graphite fiber manufacturing process, the subject is how to shorten the time required in each of infusibilization, carbonization and graphitization steps, and a calcining step capable of attaining both this shortening of time and improvement of physical properties of product has been considered necessary.

SUMMARY OF THE INVENTION

It is a first object of the present invention to provide a process for improving physical properties of pitch-based graphite fibers.

It is a second object of the present invention to provide a process for attaining improvement in physical properties of pitch-based graphite fibers and at the same time increasing the treating speed in a heat treatment step.

The above first object is attained by a pitch-based graphite fiber producing process comprising treating pitch fibers in an oxidative atmosphere which pitch fibers are obtained by melt-spinning a carbonaceous pitch, to render the fibers infusible, then heat-treating the infusible fibers at 400°–750° C. in an inert gas atmosphere to obtain precarbonized fibers substantially containing oxygen, raising the temperature to 2,000°–3,000° C. at a rate of 500° C. or higher per minute in an inert gas atmosphere and heat-treating the fibers at the raised temperature of 2,000°–3,000° C. in the inert gas atmosphere. That is, it has been found that physical properties of pitch-based graphite fibers are greatly improved by heat-treating infusiblized fibers at 400°–750° C. in an inert gas atmosphere to obtain precarbonized fibers substantially containing oxygen, then raising the temperature to 2,000°–3,000° C. at a rate of 500° C. or higher per minute and heat-treating the fibers at the raised temperature of 2,000°–3,000° C.

It has been found that the above second object is attained by winding pitch fibers onto a bobbin which pitch fibers are obtained by melt-spinning a carbonaceous pitch, then subjecting the pitch fibers thus wound onto the bobbin to an infusibilization treatment in an oxidative gas atmosphere, then heat-treating the infusible fibers at 400°–750° C. in an inert gas atmosphere to obtain precarbonized fibers, then unwinding the precarbonized fibers from the bobbin, raising the temperature to 2,000°–3,000° C. at a rate of 500° C. or higher per minute in an inert gas atmosphere and heat-treating the fibers at the raised temperature of 2,000°–3,000° C. in the inert gas atmosphere.

Further, it has been found that the above second object is attained also by treating pitch fibers obtained by melt-spinning a carbonaceous pitch, in an oxidative gas atmosphere containing 0.1–50 vol. % of $SO_2$ and/or N02 to render the fibers infusible, then heat-treating the infusible fibers at 400°–750° C. in an inert gas atmosphere to obtain precarbonized fibers substantially containing oxygen, then raising the temperature to 2,000°–3,000° C. at a rate of 500° C. or higher per minute in an inert gas atmosphere and heat-treating the fibers at the raised temperature of 2,000°–3,000° C. in the inert gas atmosphere.

It has also been found that the above second object is achieved by winding onto a bobbin pitch fibers obtained by melt-spinning a carbonaceous pitch, then subjecting the pitch fibers thus wound onto the bobbin to an infusibilization treatment in an oxidative gas atmosphere containing 0.1 to 50 vol. % of $SO_2$ and/or $NO_2$, then heat-treating the infusible fibers at 400°-750° C. in an inert gas atmosphere to obtain precarbonized fibers, then unwinding the precarbonized fibers from the bobbin, raising the temperature thereof to 2,000°-3,000° C. at a rate of 500° C. or higher per minute in an inert gas atmosphere and heat-treating the fibers at the raised temperature of 2,000°-3,000° C. in the inert gas atmosphere.

DESCRIPTION OF THE PREFERRED EMBODIMENTS

Examples of the carbonaceous pitch used in the present invention include coal pitches such as coal tar pitch and SRC (Solvent Refined Coal), petroleum pitches such as ethylene tar pitch and decant oil pitch, as well as synthetic pitches, with petroleum pitches being particularly preferred.

Various modified pitches obtained by modifying the above pitches are also included in the carbonaceous pitch referred to herein such as, for example, one treated with a hydrogen donor such as tetralin, one hydrogenated under hydrogen pressure of 20-350 $kg/cm^2$, one modified by heat treatment, one modified by solvent extraction or like means, and one modified by a suitable combination of these methods.

Thus, the term "carbonaceous pitch" used herein is a generic term of precursor pitches capable of forming pitch fibers.

The carbonaceous pitch used in the present invention may be optically isotropic or it may be optically anisotropic.

An optically anisotropic pitch is a pitch containing an optically anisotropic phase (so-called mesophase) obtained, for example, by heat-treating a pitch usually at 340°-450° C. under atmospheric or reduced pressure while passing an inert gas such as nitrogen gas. The mesophase content is preferably 5 to 100%, more preferably 60 to 95%.

The carbonaceous pitch used in the present invention has a softening point of preferably 240 to 400° C., more preferably 260 to 300° C.

Pitch fibers are obtained by melt-spinning the carbonaceous pitch by a conventional method, for example, by melting the carbonaceous pitch at a temperature higher by 30° to 80° C. than its softening point, then extruding the melt from a 0.1-0.5mm dia. nozzle and at the same time taking up the spun fibers at a rate of 100 to 2,000 meters per minute.

The pitch fibers thus obtained are rendered infusible in an oxidative gas atmosphere at a temperature usually not higher than 400° C., preferably 150°-380° C., more preferably 200°-350° C. If the treating temperature is too low, a longer treating time will be required, and a too high treating temperature would cause such a phenomenon as fusing or consumption of the pitch fibers, so both such treating temperatures are undesirable. The temperature rising rate is 0.1° to 100° C. per minute, preferably 1° to 50° C. The infusiblizing treatment time is 5 minutes to 30 hours, preferably 10 minutes to 20 hours. As the oxidative gas, one or more of such oxidative gases as oxygen, ozone, air, nitrogen oxide, sulfurous acid gas and halogen are usually employed.

It is preferable that the infusibilization treatment be performed in an oxidative gas atmosphere containing 0.1 to 50 vol. %, preferably 1 to 10 vol. % and most preferably 1 to 5 vol. %, of $SO_2$ and/or $NO_2$. In this case, oxygen and/or air containing 0.1 to 50 vol. % of $SO_2$ and/or $NO_2$ is used as the oxidative gas atmosphere. And preferably, the infusibilization reaction is carried out so that the sulfur content and/or nitrogen content of the infusiblized fibers is in the range of 0.1 to 5 wt. %, preferably 0.2 to 4 wt. %.

The fibers thus rendered infusible are then heat-treated at 400°-750° C., preferably 450°-600° C., in an inert gas atmosphere to obtain precarbonized fibers substantially containing oxygen. This precarbonizing treatment is carried out in the said temperature range, and its treating time is not specially limited, but usually it is in the range of 10 seconds to 1 hour, preferably 1 to 30 minutes.

Then, by raising the temperature of the thus-obtained precarbonized fibers at a rate of 500° C. or higher per minute and heat-treating the fibers at 2,000°-3,000° C. in an inert gas atmosphere, graphite fibers are obtained. Thus, pitch-based graphite fibers having a high strength are obtained by raising the temperature of the substantially oxygen-containing precarbonized fibers to a predetermined level of 2,000° to 3,000° C. at a rate of 500° C. or higher per minute and heat-treating the fibers at this raised temperature for a predetermined period of time. Even if substantially oxygen-free carbonized fibers are heat-treated at 2,000°-3,000° C., the strength of the resultant graphite fibers will be inferior to that of the fibers obtained according to the process of the present invention. The substantially oxygen-containing precarbonized fibers referred to herein contain 1 to 20 wt. %, preferably 3 to 10 wt. %, of oxygen. The graphitizing treatment time is 1 second to 1 hour, preferably 5 seconds to 10 minutes, and the temperature rising rate up to the graphitization temperature is 500° C. or higher, preferably 1,000° C. or higher and more preferably 1,500° C. or higher, per minute. The upper limit of the temperature rising rate is not specially limited, but usually the heat-up rate is not higher than 10,000° C. per minute.

As a preferred embodiment, for the purpose of increasing the treating speed, graphite fibers may be produced by taking up pitch fibers onto a bobbin, then subjecting the pitch fibers as wound onto the bobbin to infusibilization treatment in an oxidative gas atmosphere, then heat-treating the infusible fibers at 400°-750° C. in an inert gas atmosphere to obtain precarbonized fibers, then unwinding the precarbonized fibers from the bobbin, raising the temperature to 2,000°-3,000° C. at a rate of 500° C. or higher per minute and heat-treating the precarbonized fibers at the raised temperature of 2,000°-3,000° C.

In the above process using a bobbin, the size of the bobbin is not specially limited, but usually it is 5 to 40 cm in diameter and 10 to 100 cm in width. Its material may be, for example, stainless steel, ceramic or graphite. It is preferable that the pitch fibers be taken up under traverse motion, from the standpoint of diffusion of the oxidative atmospheric gas into the tow in the subsequent infusibilization treatment or from the standpoint of working efficiency in the unwinding step after the precarbonization treatment. The traverse angle may be chosen suitable, but usually it is 1 to 30, preferably 6 to 10, degrees.

The pitch fibers as taken up onto the bobbin are directly subjected to the infusibilization treatment in an oxidative gas atmosphere.

The fibers thus rendered infusible are, as taken up onto the bobbin, heat-treated at 400°–750° C. in an inert gas atmosphere to obtain precarbonized fibers. Then, the precarbonized fibers on the bobbin are unwound from the bobbin, then the temperature is raised to 2,000°–3,000° C. at a rate of 500° C. or higher per minute and the precarbonized fibers are subjected to graphitization treatment at the raised temperature of 2,000–3,000° C.

According to the process just described above, not only the physical properties of the graphite fibers can be improved but also the treating speed can be increased without damaging the fibers, and thus the above process is very preferable.

The following working and comparative examples are given to further illustrate the present invention, but the invention is not limited to those working examples.

EXAMPLE 1

A petroleum precursor pitch having a mesophase content of 80% and a softening point of 280° C. was melt-spun to obtain a pitch fiber having an average filament diameter of 13μ. The pitch fiber was rendered infusible by raising its temperature up to 340° C. at a rate of 10° C. per minute in oxygen and treating it at this raised temperature of 340° C. for 2 minutes. Then, the temperature was raised to 500° C. at a rate of 50° C. per minute and the infusible fiber was treated at this raised temperature of 500° C. for 10 minutes to obtain a precarbonized fiber containing 6.0 wt. % of oxygen. Then, the temperature was raised to 2,500° C. at a rate of 3,000° C. per minute and the precarbonized fiber was treated at this raised temperature of 2,500° C. for 30 seconds to obtain a graphite fiber having an average filament diameter of 10μ, an elastic modulus of 55 TON/mm$^2$ and a tensile strength of 270 kg/mm$^2$.

Comparative Example 1

The precarbonized fiber obtained in Example 1 was graphitized by raising its temperature to 2,500° C. at a rate of 20 C. per minutes and was treated at this raised temperature of 2,500° C. for 30 seconds. The graphite fiber thus obtained had an average filament diameter of 10μ, an elastic modulus of 50 TON/mm$^2$ and a tensile strength of 210 kg/mm$^2$.

Comparative Example 2

The pitch fiber obtained in Example 1 was rendered infusible by raising its temperature to 340° C. at a rate of 10° C. per minute in oxygen. Then, the temperature was raised to 1,000° C. at a rate of 10° C. per minute in nitrogen and the infusible fiber was carbonized at this raised temperature of 1,000° C. for 30 minutes to obtain a carbon fiber. The oxygen content of the carbon fiber was less than 0.5 wt. %. Then, the temperature was raised to 2,500° C. at a rate of 20° C. per minute and the carbon fiber was treated at this raised temperature of 2,500° C. for 30 seconds to obtain a graphite fiber having an average filament diameter of 10μ, an elastic modulus of 50 TON/mm$^2$ and a tensile strength of 200 kg/mm$^2$.

EXAMPLE 2

A petroleum precursor pitch having a mesophase content of 65% and a softening point of 252° C. was melt-spun to obtain a pitch fiber having an average filament diameter of 11μ. The pitch fiber was rendered infusible by raising its temperature to 320° C. at a rate of 10° C. per minute in oxygen and treating it at this raised temperature of 320° C. for 2 minutes. Then, the temperature was raised to 500° C. at a rate of 50° C. per minute and the infusible fiber was treated at this raised temperature of 500° C. for 10 minutes to obtain a precarbonized fiber containing 5 wt. % of oxygen. Then, the temperature was raised to 2,500° C. at a rate of 1,000° C. per minute and the precarbonized fiber was treated at this raised temperature of 2,500° C. for 60 seconds to obtain a graphite fiber having an average filament diameter of 9μ, an elastic modulus of 55 TON/mm$^2$ and a tensile strength of 260 kg/mm$^2$.

EXAMPLE 3

The petroleum precursor pitch used in Example 1 was melt-spun to obtain a pitch fiber having an average filament diameter of 13μ, which fiber was then wound onto a graphite bobbin having a diameter of 6 cm. Then, the temperature was raised to 225° C. at a rate of 1° C. per minute in an oxygen atmosphere and the pitch fiber on the bobbin was treated at this raised temperature of 225° C. for 8 hours to render it infusible. Then, the temperature was raised to 500° C. at a rate of 30° C. per minute in a nitrogen atmosphere and held at this raised temperature of 500° C. for 5 minutes to obtain a precarbonized fiber containing 4.5 wt. % of oxygen. The precarbonized fiber was unwound from the bobbin, then the temperature was raised to 2,500° C. at a rate of 3,000° C. per minute and the thus-unwound precarbonized fiber was treated at this raised temperature of 2,500° C. for 60 seconds to obtain a graphite fiber free of napping or breaking and having an average filament diameter of 10μ, an elastic modulus of 55 TON/mm$^2$ and an tensile strength of 260 kg/mm$^2$.

EXAMPLE 4

The pitch fiber described in Example 1 was rendered infusible by raising its temperature to 280° C. at a rate of 5° C. per minute in an oxygen atmosphere containing 5 vol. % of $SO_2$ and treating it at this raised temperature of 280° C. for 5 minutes. The fiber thus rendered infusible contained 0.9 wt. % of sulfur. Then, the temperature was raised to 500° C. at a rate of 30° C. per minute and the infusible fiber was treated at this raised temperature of 500° C. for 10 minutes to obtain a precarbonized fiber containing 3.0 wt. % of oxygen. Then, the temperature was raised to 2,500° C. at a rate of 3,000° C. per minute and the precarbonized fiber was treated at this raised temperature of 2,500° C. for 30 seconds to obtain a graphite fiber having an average filament diameter of 10μ, an elastic modulus of 60 TON/mm$^2$ and a tensile strength of 330 kg/mm$^2$.

EXAMPLE 5

The pitch fiber described in Example 2 was rendered infusible by raising its temperature to 320° C. at a rate of 5° C. per minute in air containing 5 vol. % of $SO_2$ and treating it at this raised temperature of 280° C. for 5 minutes. The fiber thus rendered infusible contained 0.8 wt. % of sulfur. Then, the temperature was raised to 500° C. at a rate of 30° C. per minute and the infusible fiber was treated at this raised temperature of 500° C. for 10 minutes to obtain a precarbonized fiber containing 2.5 wt. % of oxygen. Then, the temperature was raised to 2,500° C. at a rate of 1,000° C. per minute and the precarbonized fiber was treated at this raised temperature of 2,500° C. for 60 seconds to obtain a graphite fiber having an average filament diameter of 9μ, a elastic modulus of 55 TON/mm$^2$ and a tensile strength of 320 kg/mm$^2$.

EXAMPLE 6

The pitch fiber described in Example 1 was rendered infusible by raising its temperature from 130° C. to 280° C. at a rate of 5° C. per minute in oxygen containing 5 vol. % of $NO_2$ and treating it at this raised temperature of 280° C. for 30 minutes. The fiber thus rendered infusible contained 1.8 wt. % of nitrogen. Then, the temperature was raised to 500° C. at a rate of 30° C. per nitrogen. Then, the temperature was raised to 500° C. for 10 minutes to obtain a precarbonized fiber containing 4 wt. % of oxygen. Then, the temperature was raised to 2,500° C. at a rate of 3,000° C. per minute and the precarbonized fiber was treated at this raised temperature of 2,500° C. for 30 seconds to obtain a graphite fiber having an average filament diameter of 10$\mu$, an elastic modulus of 60 TON/mm$^2$ and a tensile strength of 330 kg/mm$^2$.

EXAMPLE 7

The pitch fiber described in Example 2 was rendered infusible by raising its temperature from 150° C. to 290° C. at a rate of 5° C. per minute in air containing 5 vol. % of $NO_2$ and treating it at this raised temperature of 290° C. for 28 minutes. The fiber thus rendered infusible contained 1.2 wt. % of nitrogen. Then, the temperature was raised to 500° C. at a rate of 30° C. per minute and the infusible fiber was treated at this raised temperature of 500° C. for 10 minutes to obtain a precarbonized fiber containing 5 wt. % of oxygen. Then, the temperature was raised to 2,500° C. at a rate of 1,000° C. per minute and the precarbonized fiber was treated at this raised temperature of 2,500° C. for 60 seconds to obtain a graphite fiber having an average filament diameter of 9$\mu$, an elastic modulus of 65 TON/mm$^2$ and a tensile strength of 320 kg/mm$^2$.

EXAMPLE 8

The pitch fiber described in Example 1 was rendered infusible by raising it temperature from 150° C. to 300° C. at a rate of 5° C. per minute in air containing 2 vol. % of $NO_2$ and rendering it at this raised temperature of 300° C. for 30 minutes. The fiber thus rendered infusible contained 0.8 wt. % of nitrogen. Then, the temperature was raised to 500° C. at a rate of 30° C. per minute and the infusible fiber was treated at this raised temperature of 500° C. for 10 minutes to obtain a precarbonized fiber containing 4.5 wt. % of oxygen. Then, the temperature was raised to 2,500° C. at a rate of 2,000° C. per minute and the precarbonized fiber was treated at this raised temperature of 2,500° C. for 30 seconds to obtain a graphite fiber thus obtained having an average filament diameter of 10$\mu$, an elastic modulus of 60 TON/mm$^2$ and a tensile strength of 310 kg/mm$^2$.

What is claimed is:

1. A process for producing a pitch-based graphite fiber, which process comprises treating a pitch fiber in an oxidative gas atmosphere to render it infusible, said pitch fiber being obtained by melt-spinning a carbonaceous pitch, then heat-treating the infusiblized fiber at 400°–750° C. in an inert gas atmosphere to obtain a precarbonized fiber containing 1 to 20 percent by weight of oxygen, then raising the temperature to 2,000°–3,000° C. at a rate of 500° C. or higher per minute in an inert gas atmosphere and heat-treating the precarbonized fiber at the raised temperature of 2,000°–3,000° C. in said inert gas atmosphere.

2. The process of claim 1, wherein said pitch fiber obtained by melt-spinning the carbonaceous pitch is wound onto a bobbin, then the pitch fiber on the bobbin is treated in the oxidative gas atmosphere and thereby rendered infusible, thereafter the thus-infusiblized fiber is heat-treated in an inert gas atmosphere to obtain the precarbonized fiber, then the precarbonized fiber is unwound from the bobbin and heat-treated at the raised temperature in an inert gas atmosphere.

3. The process of claim 1, wherein said oxidative gas is oxygen and/or air.

4. The process of claim 1, wherein said oxidative gas is oxygen and/or air containing 0.1 to 50 percent by volume of $SO_2$ and/or $NO_2$.

5. The process of claim 1, wherein said carbonaceous pitch has an optically anisotropic phase (mesophase) content of 5 to 100%.

* * * * *